US006419141B1

(12) United States Patent
Wang

(10) Patent No.: US 6,419,141 B1
(45) Date of Patent: Jul. 16, 2002

(54) TOP CAP OF POWER NAILERS

(76) Inventor: Kuan Lin Wang, 11 F-2 43 Chai-I Street, Taichung City (TW)

( * ) Notice: Subject to any disclaimer, the term of this patent is extended or adjusted under 35 U.S.C. 154(b) by 0 days.

(21) Appl. No.: 09/965,465

(22) Filed: Sep. 28, 2001

(30) Foreign Application Priority Data

Jul. 27, 2001 (TW) ..... 90213025 U

(51) Int. Cl.[7] ..... B25C 1/04
(52) U.S. Cl. ..... 227/130
(58) Field of Search ..... 227/130, 8, 10; 123/46 SC

(56) References Cited

U.S. PATENT DOCUMENTS 5,110,030 A * 5/1992 Tanji ..... 227/130
5,259,465 A * 11/1993 Mukoyama ..... 227/130
5,485,946 A * 1/1996 Jankel ..... 227/130
5,715,986 A * 2/1998 Sauer ..... 227/130
5,782,395 A * 7/1998 Sauer ..... 227/130
5,881,941 A * 3/1999 Lai ..... 227/130
5,927,584 A * 7/1999 Akiba ..... 227/130
6,059,166 A * 5/2000 Ho et al. ..... 227/130
6,173,963 B1 * 1/2001 Ho et al. ..... 227/130
6,296,168 B1 * 10/2001 Hung ..... 227/130

* cited by examiner

*Primary Examiner*—Scott A. Smith
(74) *Attorney, Agent, or Firm*—Charles E. Baxley

(57) ABSTRACT

A top cap of a power nailer includes two annular flanges in the interior of the top cap and an annular space is defined between the two flanges. A piston is movably received in the top cap and a tubular body of the piston is movably engaged with the annular space. The two flanges each have a groove which communicates with the annular space. Two seals are engaged with the two grooves so that the piston movably contacts the seals and the flanges are not scraped by the piston.

1 Claim, 3 Drawing Sheets

TOP CAP OF POWER NAILERS

FIELD OF THE INVENTION

The present invention relates to a top cap for power nailers and has seals fixedly engaged with flanges of the top cap and the piston is reciprocatingly moved in the top cap and does not scrape the flanges.

BACKGROUND OF THE INVENTION

A conventional top cap 1 of a power nailer is shown in FIG. 1 and generally includes a piston 2 reciprocatingly received in the interior 10 of top cap 1. Two annular flanges 12 extend from an inside of the top cap 1 so that the tubular body of the piston 2 is movably engaged with the gap between the two annular flanges 12. Two grooves 20 are defined in an outer periphery and inner periphery of the body so that two seals 21 are respectively engaged with the two grooves 20. The two seals 21 are moved along the surfaces of the two annular flanges 12 when the piston 2 is moved. A communication path 13 is defined through the top cap 1 so as to push the piston 2 downward and the air escapes from the hole 11 when the piston 2 moves upward. The top cap 1 is made from Magnesium Alloy so that a metal coating is coated on the top cap 1. The frequent movement of the seals 21 on the surface of the Magnesium Alloy wears out the metal coating so that the Magnesium Alloy becomes to be fragile.

SUMMARY OF THE INVENTION

In accordance with one aspect of the present invention, there is provided a An assembly of a top cap and a piston a power nailer. The top cap comprises a communication path defined through the top cap and communicating with an interior in the top cap so that a piston is movably received in the interior. A hole is defined through a top of the top cap and communicates with the interior. Two annular flanges extend from an inside of the top cap and an annular space is defined between the two flanges. Each of the two flanges has a groove defined therein and the two respective grooves communicate with the annular space. Two seals are respectively engaged with the two respective grooves. A tubular body of the the piston is engaged with the annular space and contacts the two seals. A spring is biased between the piston and an inside of the top cap.

The primary object of the present invention is to provide a top cap that has fixed seals in the flanges and the piston movably contacts the seals so that the flanges will not be worn out.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
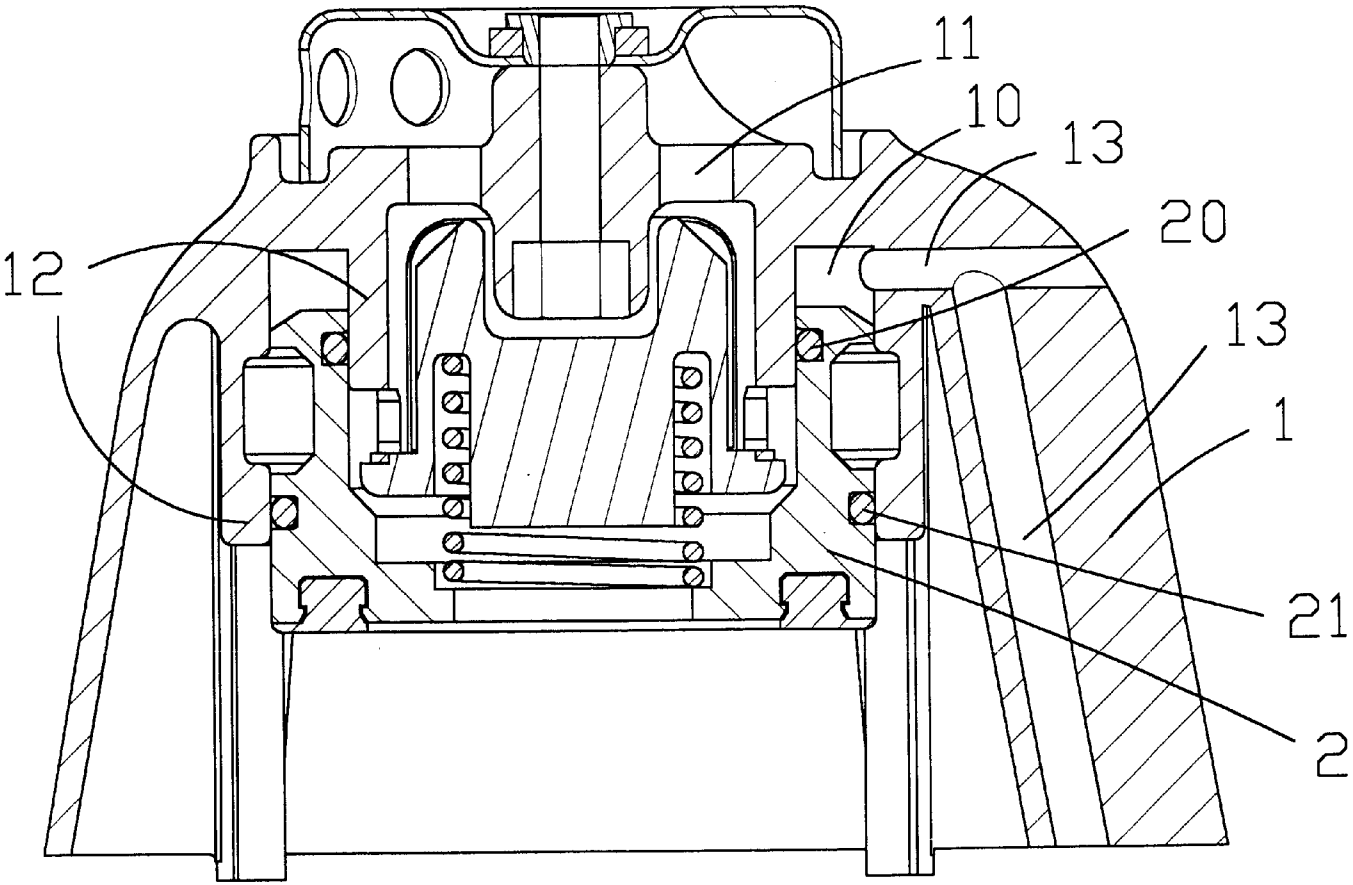
FIG.1 PRIOR ART
FIG. 1 is a cross sectional view to show a conventional top cap.
Figure 2:
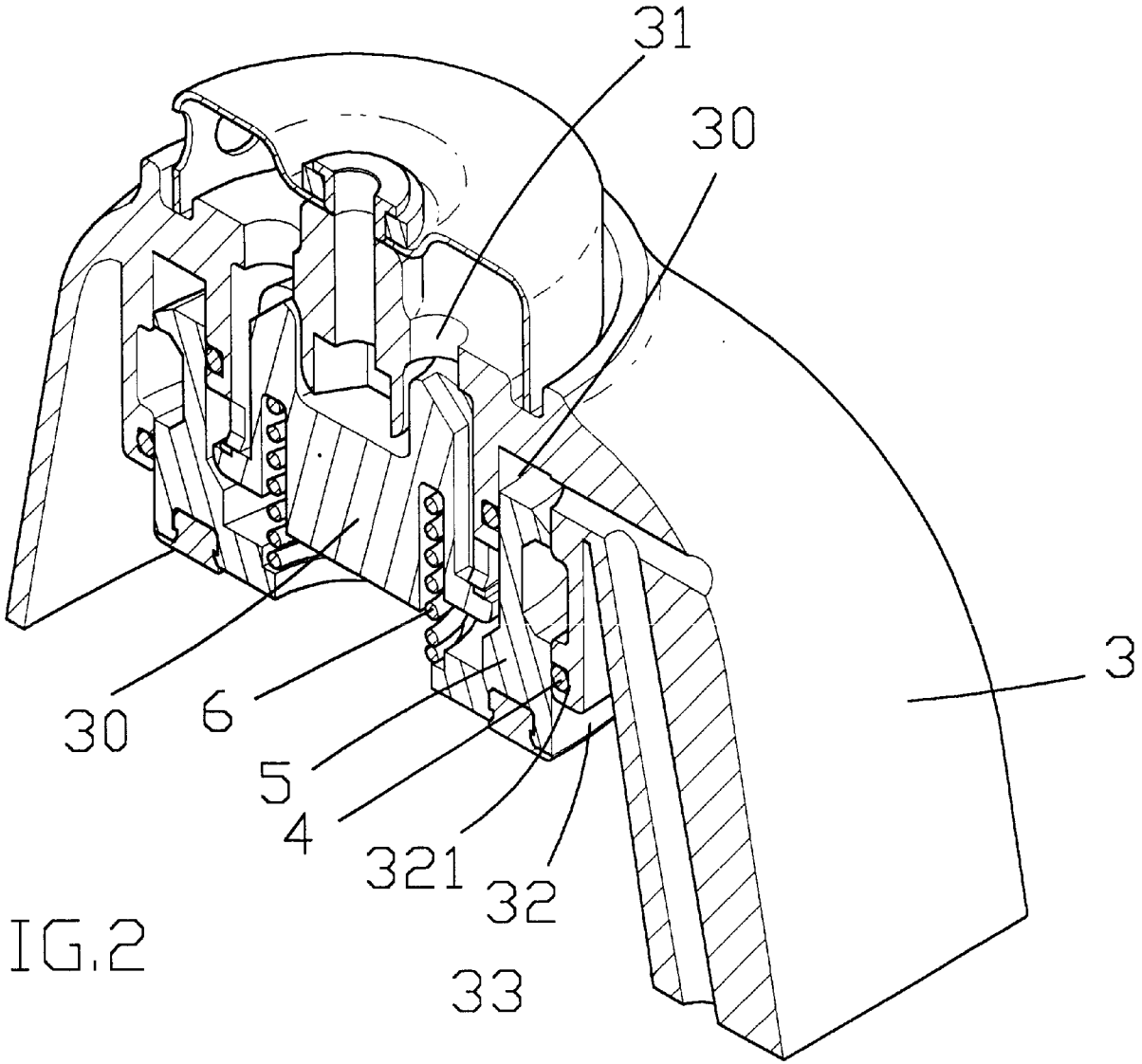
FIG. 2 is a cross sectional view to show the top cap of the present invention.
Figure 3:
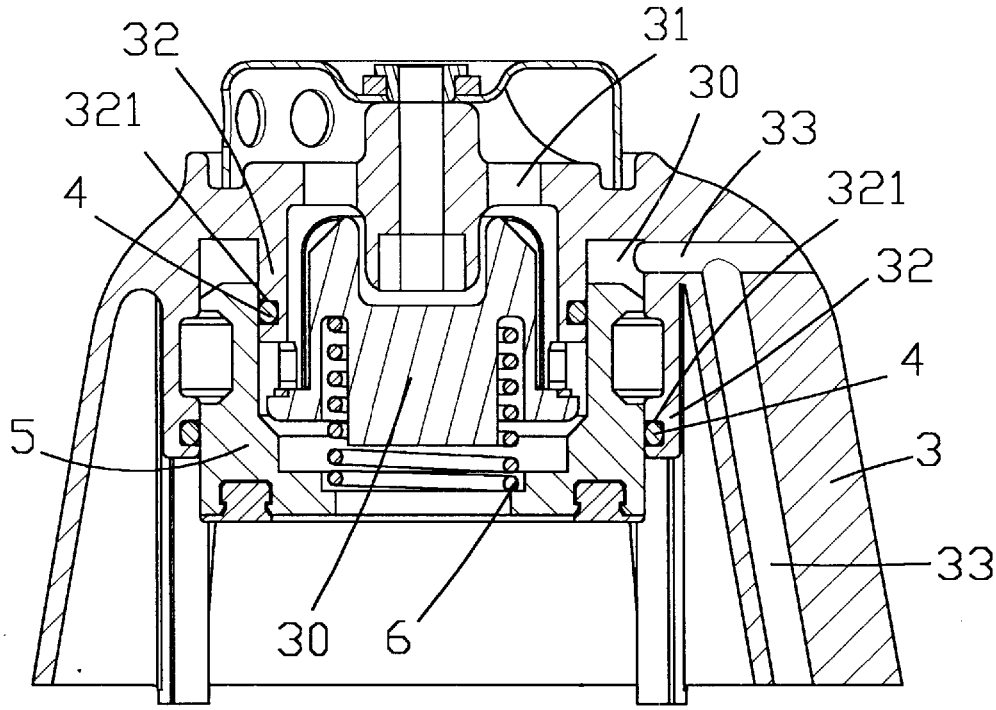
FIG. 3 is a cross sectional view to show the top cap of the present invention wherein the piston is not moved downward.
Figure 4:
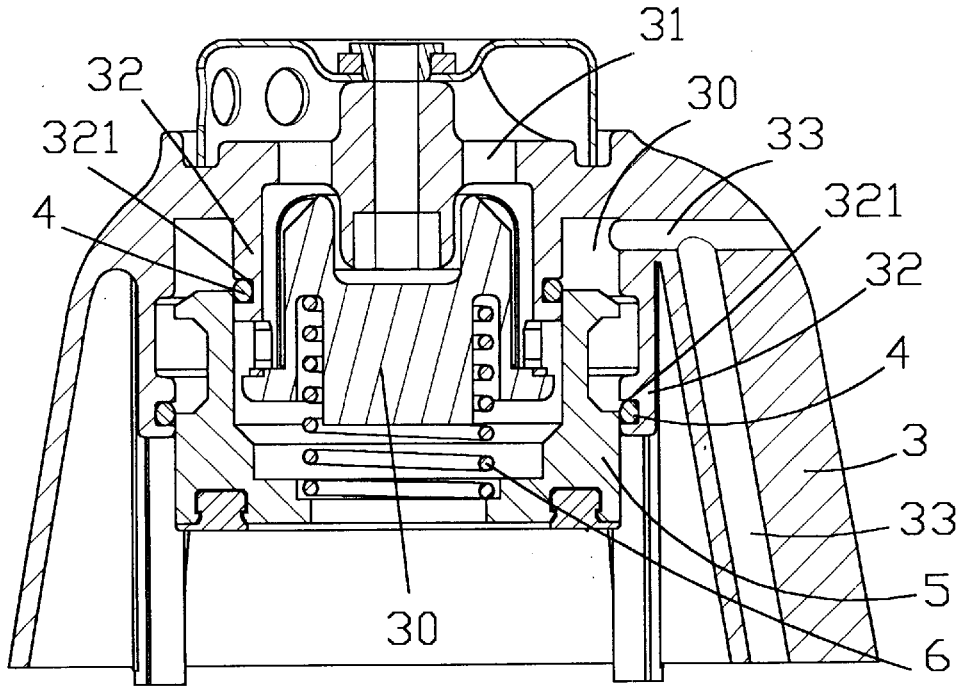
FIG. 4 is a cross sectional view to show the top cap of the present invention wherein the piston is moved downward.

Referring to FIGS. 2 to 4, the top cap 3 of the present invention comprises a communication path 33 defined therethrough and communicating with an interior 30 in the top cap 3. A hole 31 is defined through a top of the top cap 3 and communicates with the interior 30. Two annular flanges 32 extend from an inside of the top cap 3 and an annular space is defined between the two flanges 32. Each of the two flanges 32 has a groove 321 defined therein and the two respective grooves 321 communicate with the annular space. Two seals 4 are respectively engaged with the two respective grooves 321.

A piston 5 is movably received in the interior 30 of the top cap 3 and has a tubular body engaged with the annular space. The tubular body contacts the two seals 4 so that the surfaces of the two flanges 32 are not scraped by the piston 5. A spring 6 is biased between the piston 5 and a member 30 in an inside of the top cap 3 so as to bring the piston 5 upward to its original position.

By the structure, the metal coating on the top cap 3 can be maintained and the life of the top cap 3 is then prolonged.

While we have shown and described the embodiment in accordance with the present invention, it should be clear to those skilled in the art that further embodiments may be made without departing from the scope of the present invention.

What is claimed is:

1. An assembly of a top cap and a piston a power nailer, comprising:

a communication path defined through said top cap and communicating with an interior in said top cap, a hole defined through a top of said top cap and communicating with said interior, two annular flanges extending from an inside of said top cap and an annular space defined between said two flanges, each of said two flanges having a groove defined therein and said two respective grooves communicating with said annular space, two seals respectively engaged with said two respective grooves;

said piston movably received in said interior of said top cap and having a tubular body engaged with said annular space, said tubular body contacting said two seals, and a spring biased between said piston and an inside of said top cap.

* * * * *